US010040180B2

(12) United States Patent
Foser

(10) Patent No.: US 10,040,180 B2
(45) Date of Patent: Aug. 7, 2018

(54) DRIVING-IN DEVICE

(71) Applicant: Hilti Aktiengesellschaft, Schaan (LI)

(72) Inventor: Thomas Foser, Balzers (LI)

(73) Assignee: Hilti Aktiengesellschaft, Schaan (LI)

( * ) Notice: Subject to any disclaimer, the term of this patent is extended or adjusted under 35 U.S.C. 154(b) by 503 days.

(21) Appl. No.: 14/759,146

(22) PCT Filed: Jan. 14, 2014

(86) PCT No.: PCT/EP2014/050559
§ 371 (c)(1),
(2) Date: Jul. 2, 2015

(87) PCT Pub. No.: WO2014/111366
PCT Pub. Date: Jul. 24, 2014

(65) Prior Publication Data

US 2015/0360353 A1 Dec. 17, 2015

(30) Foreign Application Priority Data

Jan. 16, 2013 (DE) ..... 10 2013 200 551

(51) Int. Cl.
*B25C 1/00* (2006.01)
*B25B 23/04* (2006.01)
(Continued)

(52) U.S. Cl.
CPC ..... *B25B 23/045* (2013.01); *B25C 1/003* (2013.01); *B25C 1/184* (2013.01); *B25C 7/00* (2013.01)

(58) Field of Classification Search
CPC B25C 1/008; B25C 1/005; B25C 1/04; B25C 1/047; B25C 1/08; B25C 7/00;
(Continued)

(56) References Cited

U.S. PATENT DOCUMENTS 3,708,097 A * 1/1973 Fisher ..... B25C 1/003 227/136
3,891,014 A * 6/1975 Gunn ..... B25B 23/06 221/232

(Continued)

FOREIGN PATENT DOCUMENTS

GB 2 332 383 A 6/1999
JP 10-058349 A 3/1998
JP 3333114 B2 1/1999

OTHER PUBLICATIONS

International Search Report, PCT/EP2014/050559, dated Apr. 17, 2014.

*Primary Examiner* — Scott A. Smith
(74) *Attorney, Agent, or Firm* — Leydig Voit & Mayer

(57) ABSTRACT

A device for driving fastening elements into an underlying surface has a mount for a fastening element, having a through-passage for a driving-in element, by which a fastening element in the mount is driven into the underlying surface in a driving-in direction, having a strip lead-through, which defines a strip plane and a transporting direction and is intended for a fastening-element bearing strip core, having a supporting element for supporting the strip and/or a fastening element, and having a supporting spring, wherein the supporting element can be deflected transversely to the driving-in direction, counter to a force of the supporting spring, when a fastening element is moved in the driving-in direction by the driving-in element in order for the fastening element to be separated from the strip.

20 Claims, 2 Drawing Sheets

Figure 1:
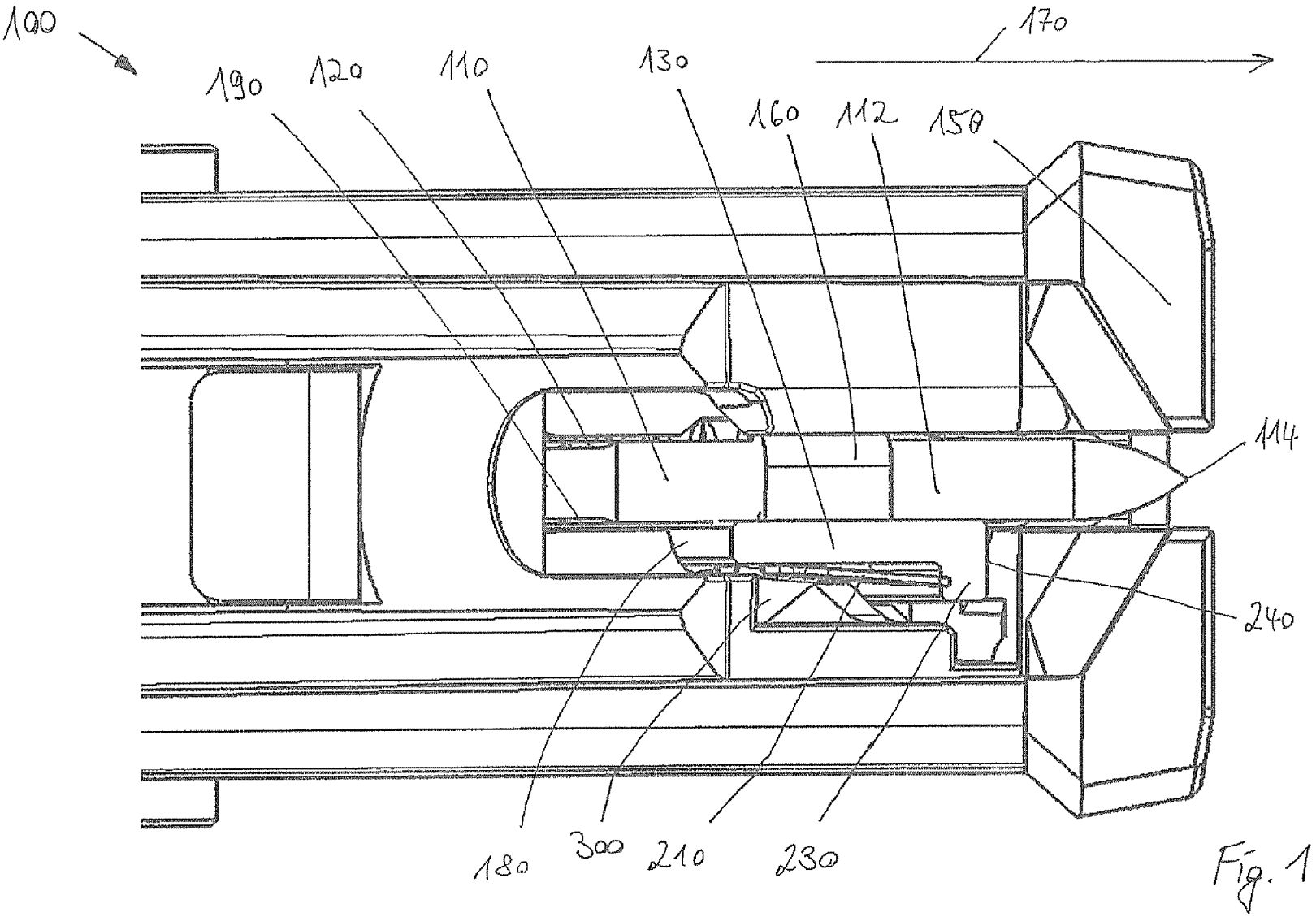

(51) Int. Cl.
*B25C 1/18* (2006.01)
*B25C 7/00* (2006.01)

(58) Field of Classification Search
CPC ..... B25C 5/1627; B25C 5/1637; B25C 1/00; B25C 1/003; B25C 1/184; B25C 1/18; B25B 23/00; B25B 23/005; B25B 23/045; B25B 23/08; B25B 23/04
USPC ..... 227/8, 10, 119, 120, 109, 135, 136, 138, 227/139, 147, 123; 81/433, 434, 435, 81/57.37
See application file for complete search history.

(56) References Cited

U.S. PATENT DOCUMENTS 3,910,324 A * 10/1975 Nasiatka ..... B25B 23/045 206/347
4,014,488 A * 3/1977 Potucek ..... B25B 23/045 226/147
4,319,705 A * 3/1982 Geist ..... B25C 1/003 227/120
4,404,877 A * 9/1983 Mizuno ..... B25B 23/045 227/136
4,767,043 A * 8/1988 Canlas, Jr. ..... B25C 1/008 227/130
4,863,089 A * 9/1989 McCardle ..... B25C 1/003 227/116
4,930,673 A * 6/1990 Pfister ..... B25C 1/184 227/10
5,101,697 A * 4/1992 Fishback ..... B25B 23/045 81/433
5,186,085 A * 2/1993 Monacelli ..... B25B 23/045 227/120
5,273,200 A * 12/1993 Hoefler ..... B25C 1/003 227/119
5,284,074 A * 2/1994 Chen ..... B25B 23/045 81/433
5,332,141 A * 7/1994 Mukoyama ..... B25C 1/003 227/136
5,685,473 A 11/1997 Shkolnikov et al.
5,799,856 A * 9/1998 Mukoyama ..... B25C 1/003 112/112
5,975,399 A * 11/1999 Oehri ..... B25C 1/184 227/120
6,109,146 A 8/2000 Muro
6,123,244 A 9/2000 Huang
6,308,880 B1 * 10/2001 Ronconi ..... B25C 1/003 227/119
6,598,777 B2 * 7/2003 Osuga ..... B25C 1/00 227/119
6,601,480 B1 * 8/2003 Habermehl ..... B25B 23/045 227/136
6,685,078 B2 * 2/2004 Wohlwend ..... B25C 1/184 227/109
6,783,044 B2 * 8/2004 Perra ..... B25C 1/008 227/142
6,862,963 B2 * 3/2005 Habermehl ..... B25B 23/045 227/136
7,143,919 B2 * 12/2006 Weibel ..... B25C 1/184 227/10
7,172,103 B2 * 2/2007 Fujiyama ..... B25B 23/045 227/107
7,415,910 B2 * 8/2008 Arai ..... B25B 23/04 81/433
2008/0251560 A1 * 10/2008 Almeras ..... B25C 1/184 227/10

* cited by examiner

DRIVING-IN DEVICE

CROSS-REFERENCE TO RELATED APPLICATIONS

The application is the U.S. National Stage of International Application Number PCT/EP2014/050559, filed on Jan. 14, 2014, which claims the benefit of German Patent Application Number 10 2013 200 551.2, filed on Jan. 16, 2013, which are each incorporated by reference.

The invention concerns a device for the driving in of fastening elements into a substrate and a fastening system with a drive-in device and a strip.

Such driving-in devices usually comprise a holder for a fastening element and a passage for a driving-in element, which drives in the fastening element from the holder, in a driving-in direction, into the substrate. The fastening elements are usually magazined with the aid of a strip and transported through a lead-through of the driving-in device into the holder. For the driving into the substrate, a fastening element, for example, a screw, which is in a holder, is grasped by the driving-in element, for example, a screwdriver bit, and moved in the driving-in direction. Since the following fastening elements, which are still in the lead-through, support the strip opposite the driving-in direction, the fastening element, grasped by the driving-in element, is separated from the strip. As a result of the undefined support by the remaining strip, the fastening element tends to tilt during the separation, since the fastening element is impinged on by forces traverse to the fastening direction during the driving in. The tilting impairs, on the one hand, the driving-in quality and increases, on the other hand, the force required for the separation of the fastening element.

The strips that carry the fastening elements comprise—in addition to the fastening elements—a strip core, on which the fastening elements are held. On the usually flat-shaped strip core, which thus defines a strip plane, the fastening elements are usually held, lined up along a longitudinal direction of the strip.

In a first known embodiment, the fastening elements define a fastening direction, which is oriented parallel to the strip plane. Here, however, a reliable support of the strip core is not possible, when a fastening element is to be separated from the strip in a fastening direction. Rather, the support is usually carried out via the adjacent fastening elements, in so far as they are still held on the strip core.

In another known embodiment, the fastening elements define a fastening direction, which is oriented perpendicular to the strip plane. Here, with a sufficient width of the strip core, a support is possible, but for the separation, a head of the fastening element has to be pressed through the strip core, which is connected with an increased expenditure of force. For this to be possible at all, such a strip core has to be made of a very soft or elastic material, so that the strip, as a whole, has a very low dimensional stability, wherein handling the strip is complicated.

A goal of the invention is to make available a driving-in device and a fastening system with a strip with which the driving-in quality is possibly improved.

The goal is attained by a device for the driving in of fastening elements into a substrate, with a holder for a fastening element, with a passage for a driving-in element, which drives in a fastening element in the holder, in a driving-in direction, into the substrate, with a strip plane and a strip lead-through, which defines a transporting direction, for a strip core carrying fastening elements, with a supporting element to support the strip and/or a fastening element, and with a support spring, wherein the support element can be deflected transverse to the driving-in direction against a force of the supporting spring, when a fastening element is moved by the driving-in element in the driving-in direction, so as to separate the fastening element from the strip. Preferably, the supporting element can also be deflected transverse to the transporting direction against the force of the supporting spring.

A preferred embodiment is characterized in that the supporting element, in particular, has a plane supporting surface, which is directed opposite the driving-in direction or at an acute angle, in a direction contrary to the driving-in direction, and is, in particular, oriented transverse to the strip plane, in order to support the strip in a direction contrary to the driving-in direction, when a fastening element is moved from the driving element, in the driving-in direction, so as to separate the fastening element from the strip.

A preferred embodiment is characterized in that the supporting element comprises the supporting spring. With particular preference, the supporting element is formed from the supporting spring.

A preferred embodiment is characterized in that the strip lead-through and/or the holder have/has a recess, into which the strip can be moved transverse to the transporting direction and transverse to the driving-in direction, when a fastening element in the holder is separated from the strip. With particular preference, the supporting element can be deflected, against the force of the supporting spring, into the recess.

A preferred embodiment is characterized in that it has a contact sensor, which conveys a fastening element along the lead-through in the transporting direction into the holder, when the device is pressed against a substrate and/or when the driving-in process has ended.

A preferred embodiment is characterized in that the support spring has a leaf spring. In accordance with another embodiment, the support spring, additionally or alternatively, has one or more leaf springs, spiral springs, and/or coil springs.

A preferred embodiment is characterized in that the supporting element is arranged, transverse to the transporting direction and transverse to the driving-in direction, next to the holder, and is oriented transverse to the strip plane.

A preferred embodiment is characterized in that an opening of the strip lead-through into the holder has a first end on the driving-in direction side and a second end, in a direction contrary to the driving-in direction, and wherein the supporting element is arranged closer to the first than to the second end of the opening. Preferably, the supporting element has a prolongation of the strip lead-through in the transporting direction. With particular preference, the supporting element thereby extends beyond the opening.

A preferred embodiment is characterized in that the strip lead-through and/or the holder have/has a recess into which the strip can be moved transverse to the transporting direction and transverse to the driving-in direction, when a fastening element in the holder is separated from the strip.

A preferred embodiment is characterized in that the supporting element has a supporting surface, which, in particular, points in a direction contrary to the driving-in direction.

The goal is likewise attained by a fastening system, with a device, in accordance with the invention, for driving in fastening elements into a substrate, and with a strip for fastening elements with a shaft and, in particular, a head, comprising a strip core, which defines a strip plane and a strip longitudinal direction, and several fastening elements, which are held on the strip core and each of which defines a fastening direction, which is oriented parallel to the strip plane, wherein the strip core or at least one of the fastening elements, in particular, has a plane counter-supporting surface, and wherein the supporting element, in particular, the supporting surface, supports the counter-supporting surface contrary to the driving-in direction, when a fastening element in the holder is moved in the driving-in direction.

A preferred embodiment is characterized in that the fastening elements each has a head, which loads the strip core against the supporting element, when the individual fastening element in the holder is separated from the strip.

A preferred embodiment is characterized in that the fastening elements each has a head, which moves the strip core or the supporting foot into the recess, when the individual fastening element in the holder is separated from the strip.

A preferred embodiment is characterized in that the counter-supporting surface is arranged on the front side of the strip core, which points in the fastening direction. With particular preference, the counter-supporting surface forms the front side of the strip core, which points in the fastening direction.

A preferred embodiment is characterized in that the strip core has a transporting recess. With particular preference, the transporting recess is arranged in the strip longitudinal direction, at the height of a fastening element. In accordance with a likewise preferred variant, the transporting recess is arranged, in the strip longitudinal direction, between two fastening elements. Preferably, the counter-supporting surface limits the transporting recess, for example, as a side surface or as a closing edge.

A preferred embodiment is characterized in that the fastening elements are held in holders of the strip, which project from the strip core, transverse to the strip plane, on the side lying opposite the transporting recess.

A preferred embodiment is characterized in that from the strip core, a supporting foot projects transverse to the strip plane. Preferably, the supporting foot projects from the strip core on the front side of the strip core that points in the fastening direction.

A preferred embodiment is characterized in that the supporting foot is arranged in the strip longitudinal direction, at the height of the fastening element. A likewise preferred embodiment is characterized in that the supporting foot is arranged, in the strip longitudinal direction, between two fastening elements. With particular preference, the supporting foot is continuously formed, in the strip longitudinal direction, along several fastening elements.

A preferred embodiment is characterized in that the supporting foot has a plane supporting surface, which, with particular preference, forms the front side of the strip that points in the fastening direction.

A preferred embodiment is characterized in that the supporting element supports the supporting foot in a direction contrary to the driving-in direction, when a fastening element in the holder is moved in the driving-in direction. With particular preference, the supporting element from the strip thereby supports only the supporting foot in a direction contrary to the driving-in direction.

Figure 2:
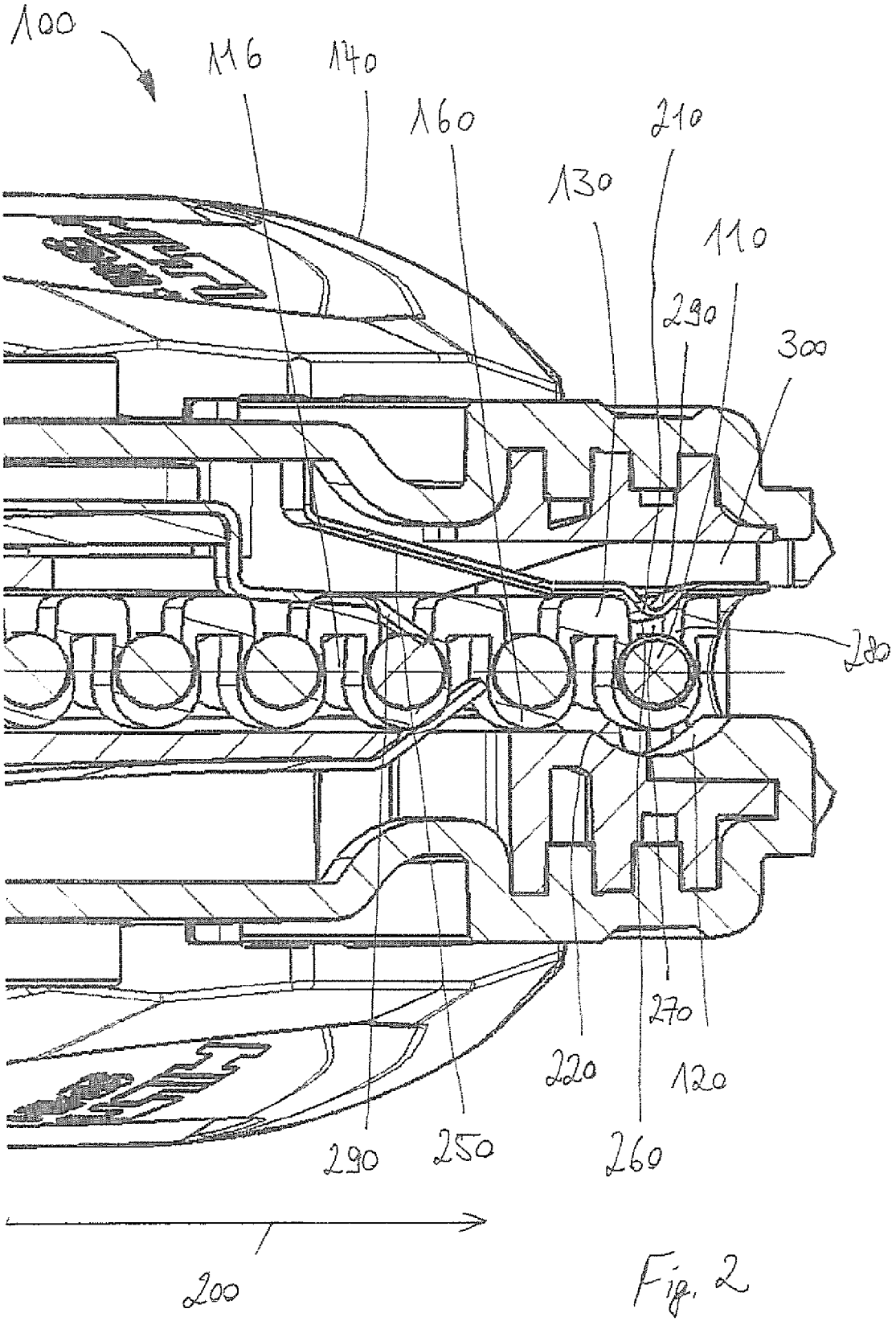

Below, preferred embodiment examples are explained in more detail with reference to the drawings. The figures show the following:

FIG. 1 a driving-in device with a fastening element strip;

FIG. 2 the driving-in device with the fastening element strip in a cross-section.

FIGS. 1 and 2 show a driving-in device 100, designed as a magazine attachment, for fastening elements 110, which are held on a strip core 130. The driving-in device 100 has a holder 120 for one of the fastening elements 110 and a passage, covered by the fastening elements 110, for a nondepicted driving-in element, designed, for example, as a screw drive, which drives a fastening element 110 that was positioned beforehand in the holder 120 into a nondepicted substrate. Furthermore, the driving-in device 100 has a housing 140, which is fastened on a nondepicted drive device, which preferably holds, in a detachable manner, the driving-in element, such as a cordless screwdriver with an electric motor, in order to drive the driving-in element, especially in a rotating manner. With nondepicted examples, the fastening elements are designed as screw anchors, bolts, threaded bolts, nails, rivets, or the like.

The driving-in device 100 has a strip lead-through 180 for the strip core 130 and a screw guidance 190 for the fastening elements 110. The strip lead-through 180 is designed as a flat recess in the screw guidance 190 and thus defines a strip plane, which is oriented perpendicular to the drawing plane in FIGS. 1 and 2 and is stretched from the driving-in direction 170, shown in FIG. 1, and the transporting direction 200, shown in FIG. 2. The transporting direction 200 defined by the strip lead-through 180 runs at an incline to the left in the drawing plane in FIG. 1, and in FIG. 2 in the drawing plane from left to right. A mouth 220 marks the location on which the strip lead-through 180 opens into the holder 120.

Furthermore, the driving-in device 100 comprises a supporting element 210 to support the strip core 130 in a direction contrary to the driving-in direction and a supporting spring 250 designed as a leaf spring, which is made of a metal or an alloy and continues in the supporting element 210. A front edge 260 of the supporting element 210, pointing, in FIG. 2, into the drawing plane, serves as a supporting surface for a support of the strip core 130 in a direction contrary to the driving-in direction 170. For this purpose, the strip core 130 has a plane counter-supporting surface 270, which is a part of a limitation of a transporting recess 280 provided on the strip core 130. The transporting recess 280 is used thereby to hold a transporting arm 290, which transports the strip core 130 by engaging the transporting recess 280 along the transporting direction 200 toward the holder 120.

The supporting element 210 has a preferably bead-shaped projection 290, which protrudes into the transporting recess 280. The supporting element 210 can be deflected transversely, preferably at a right angle to the transporting direction 200, namely upwards in FIG. 2, and transversely, preferably at a right angle to the driving-in direction 170, namely downwards in FIG. 1, against the spring force of the supporting spring 250. When a fastening element 110 is moved from the driving-in element in the driving-in direction 170, in order to separate the fastening element 110 from the strip, the supporting element 210 is thus used as a support for the strip core 130 opposite the driving-in direction 170.

Furthermore, the driving-in device 100 comprises a contact sensor 150, which activates a transporting mechanism for the transporting of a fastening element 110 into the holder 120, when the driving-in device 100 presses against the substrate and/or when a driving-in process is ended. The contact sensor 150 and with it also the transporting mechanism are moved, for the purpose, against a contact spring located in the housing 140, toward the housing 140, during the pressing against the substrate, and upon lifting the driving-in device 100 from the substrate, correspondingly moved away from the housing 140 by the contact spring.

The fastening elements 110 are held on the strip core 130 and together with the strip core 130, form a fastening element strip. The flat-shaped strip core 130 defines a strip plane, which is identical with the previously described strip plane defined by the strip lead-through 180, and a strip longitudinal direction, which is identical with the previously described transporting direction 200. The strip core 130 is made of plastic and comprises a large number of holders 160 connected with one another for the temporary holding of the shaft 112 of a fastening element 110. Each holder 160 thereby defines a fastening direction, in which the individual fastening element 110 can be driven into the substrate from the holder 160, and which, in the present case, is identical with the driving-in direction 170. The fastening elements 110 are thereby preferably held in the middle—that is, with their center of gravity within a holder 120. Each fastening element 110 has, on its fastening-direction end, a tip 114, shown in FIG. 1, and on its end, opposite the fastening direction, a head 116, shown in FIG. 2.

The fastening element strip has a supporting foot 230, which projects transverse to the strip plane from the strip core 130, on its front side 240, which points in the fastening direction, that is, on the side of the strip core 130 that lies opposite the holders 160. The supporting foot 230 is continuously formed in the strip longitudinal direction along several fastening elements 110 and thus, is arranged in the strip longitudinal direction both at the height of the fastening elements 110 and also between the fastening elements 110. The supporting foot 230 has a plane supporting surface, which forms the front side 240 of the strip core 130, pointing in the fastening direction. In nondepicted embodiment examples, a supporting foot projects from the strip core, alternatively or additionally, in a front side that points in a direction contrary to the fastening direction or also in the area between the two front sides. In other nondepicted embodiment examples, the fastening element strip does not have a projecting supporting foot.

When the driving-in element moves a fastening element 110 in the holder 120 in order to drive into a substrate in the driving-in direction 170, the counter-supporting surface 270 and thus the strip core 130 are supported by the supporting element 210 contrary to the driving-in direction 170. Therefore, the strip core 130 does not move with the fastening element 110. As soon as the head of the fastening element 110 passes the holder 160, the material of the holder 160 is stretched beyond its stretching limit, so that the holder 160 tears and the fastening element 110 is separated. The required force for the separation is, in particular, reduced in that the strip core 130, together with the supporting foot 230, can escape into a recess 300 of the strip lead-through 180, in order to allow the head 116 to pass with a reduced side force impingement. The strip core 130 is hereby loaded against the supporting element 210 so that the strip core 130, together with the supporting element 210, is deflected against the spring force of the supporting spring 250 into the recess 300.

The invention under consideration was described with the example of a driving-in device for fastening elements. It should be noted, however, that the device in accordance with the invention is also suitable for other application purposes.

The invention claimed is:

1. A device for driving fastening elements into a substrate, the device comprising a holder for a fastening element, a strip comprising a strip core defining a strip plane and a strip longitudinal direction and having fastening elements, which are held on the strip core, a strip transport channel, which defines a transporting direction, for the strip core carrying fastening elements, a passage for a driving-in element, wherein the driving-in element drives the fastening element in the holder in a driving-in direction into the substrate, a supporting element supporting the strip, and a supporting spring, wherein the supporting element is deflected, transverse to the driving-in direction, against a force of the supporting spring, when the fastening element is moved by the driving-in element in the driving-in direction in order to separate the fastening element from the strip, wherein each of the fastening elements has a head, the head loading the strip core against the supporting element when the individual fastening element in the holder is separated from the strip.

2. The device according to claim 1, wherein the supporting element has a supporting surface, which points in a direction opposite to the driving-in direction or, points at an acute angle to a direction opposite to the driving-in direction, wherein the supporting surface is oriented transverse to the strip plane, in order to support the strip in a direction opposite to the driving-in direction, when a fastening element is moved by the driving-in element in the driving-in direction, so as to separate the fastening element from the strip.

3. The device according to claim 2, wherein the supporting element is deflected, transverse to the transporting direction, against the force of the supporting spring, when the head of the individual fastening element loads the strip core against the supporting element.

4. The device according to claim 1, wherein the supporting element is deflected, transverse to the transporting direction, against the force of the supporting spring, when the head of the individual fastening element loads the strip core against the supporting element.

5. The device according to claim 1, wherein the supporting element comprises the supporting spring.

6. The device according to claim 1, wherein the strip transport channel has a recess, into which the strip is moved transverse to the transporting direction and transverse to the driving-in direction, when a fastening element in the holder is separated from the strip.

7. The device according to claim 6, wherein the supporting element is deflected, against the force of the supporting spring, into the recess, when a fastening element is moved by the driving-in element in the driving-in direction, in order to separate the fastening element from the strip.

8. The device according to claim 6, wherein the head of the fastening element moves the strip core or a supporting foot of the strip core into the recess, when the individual fastening element in the holder is separated from the strip.

9. The device according to claim 1, further comprising a contact sensor, which feeds a fastening element along the strip transport channel in the transporting direction into the holder, when the device is pressed against a substrate.

10. The device according to claim 1, wherein the supporting spring is a leaf spring.

11. The device according to claim 1, wherein the strip core has a counter-supporting surface and wherein the supporting element supports the counter-supporting surface in a direction opposite to the driving-in direction, when a fastening element in the holder is moved in the driving-in direction.

12. The device according to claim 11, wherein the counter-supporting surface is arranged on a front side of the strip core, which points in the driving-in direction.

13. The device according to claim 11, wherein the strip core has a transporting recess.

14. The device according to claim 13, wherein the counter-supporting surface defines the transporting recess.

15. The device according to claim 13, wherein the fastening elements are held in holders that project, on a side lying opposite the transporting recess, from the strip core transverse to the strip plane.

16. The device according to claim 1, wherein the holder has a recess, into which the strip is moved transverse to the transporting direction and transverse to the driving-in direction, when a fastening element in the holder is separated from the strip.

17. The device according to claim 1, wherein the supporting element supports the strip core.

18. The device according to claim 1, wherein the supporting element supports a fastening element of the strip.

19. The device according to claim 1, further comprising a contact sensor, which feeds a fastening element along the strip transport channel in the transporting direction into the holder, when the driving-in is ended.

20. The device according to claim 1, wherein at least one of the fastening elements has a counter-supporting surface and wherein the supporting element supports the counter-supporting surface in a direction opposite to the driving-in direction, when a fastening element in the holder is moved in the driving-in direction.

* * * * *